United States Patent [19]

Appleton

[11] 3,975,604

[45] Aug. 17, 1976

[54] MODULAR ELECTRICAL SWITCH WITH SPLIT HOUSING

[76] Inventor: Arthur I. Appleton, 1 Bridlewood Road, Northbrook, Ill. 60062

[22] Filed: Dec. 9, 1974

[21] Appl. No.: 531,084

[52] U.S. Cl. ..... 200/303; 200/307

[51] Int. Cl.[2] ..... H01H 9/08

[58] Field of Search ..... 248/27; 174/53, 55; 317/112, 118, 120; 339/125 R, 126 R, 76, 77; 200/5 R, 5 B, 18, 51 R, 51.02, 51.04, 153 V, 153 T, 159 R, 243, 293, 294, 296, 297, 303, 307, 340

[56] References Cited

UNITED STATES PATENTS

| | | | |
|---|---|---|---|
| 1,938,309 | 12/1933 | Williams | 174/55 |
| 2,531,350 | 11/1950 | Chrastina | 200/51 R |
| 2,813,160 | 11/1957 | Tong | 200/153 T |
| 3,105,130 | 9/1963 | Weiford, Jr. | 200/153 T |
| 3,183,501 | 5/1965 | Seaton | 200/18 |
| 3,231,706 | 1/1966 | Waldorf | 200/307 |
| 3,286,070 | 11/1966 | Volker | 200/307 |
| 3,319,036 | 5/1967 | McGary | 200/307 |
| 3,514,554 | 5/1970 | Baysen | 200/307 |
| 3,851,226 | 11/1974 | Chen | 317/120 |

FOREIGN PATENTS OR APPLICATIONS

| | | | |
|---|---|---|---|
| 1,615,888 | 8/1970 | Germany | 200/307 |

*Primary Examiner*—Gerald P. Tolin
*Attorney, Agent, or Firm*—Darbo, Robertson & Vandenburgh

[57] ABSTRACT

The rear cover of a switch housing is removble and supports a plurality of individual switch units. Each switch unit has an axially positioned switch actuating plunger. The housing has a push-button mechanism positioned to contact the switch plungers. On the exterior of the switch unit are spring contacts which engage spring contacts on the housing. The housing has wiring connectors electrically connected to the housing spring contacts. By removal of the rear cover the switch units are withdrawn from the housing without the necessity for disconnecting the wires. The switch units and housing components can be stacked so as to increase the number of switches actuated by the push-button mechanism.

10 Claims, 12 Drawing Figures ig.6.

Fig. 1.
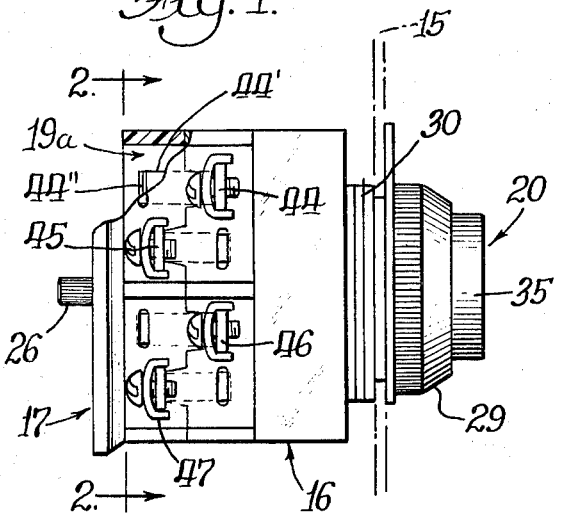
Fig. 2.
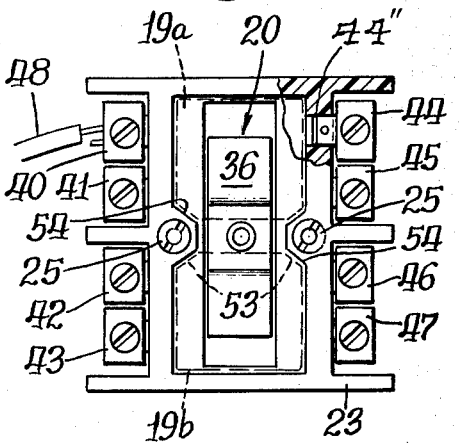
Fig. 3.
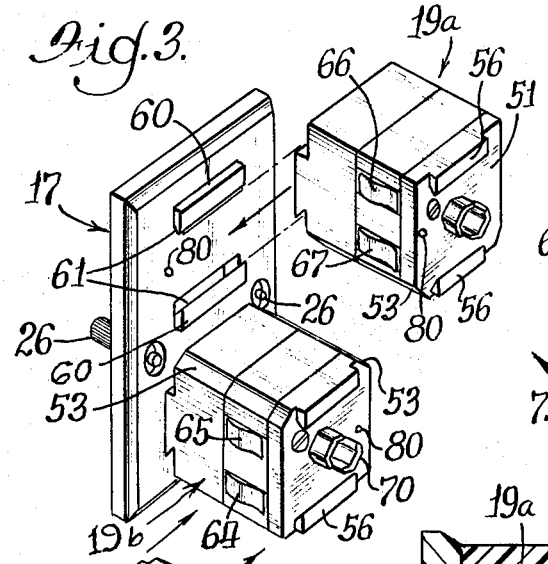
Fig. 5.
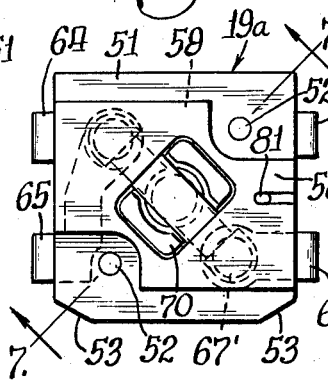
Fig. 4.
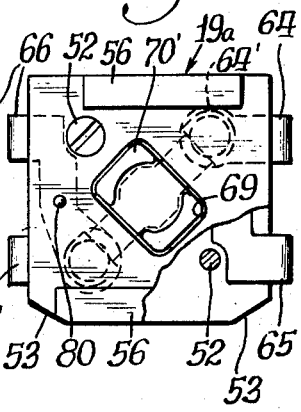
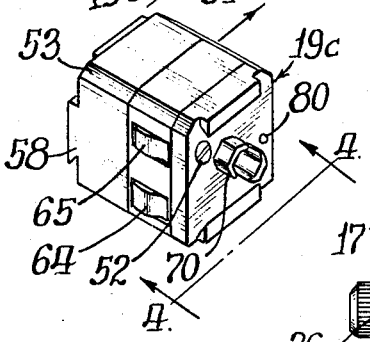
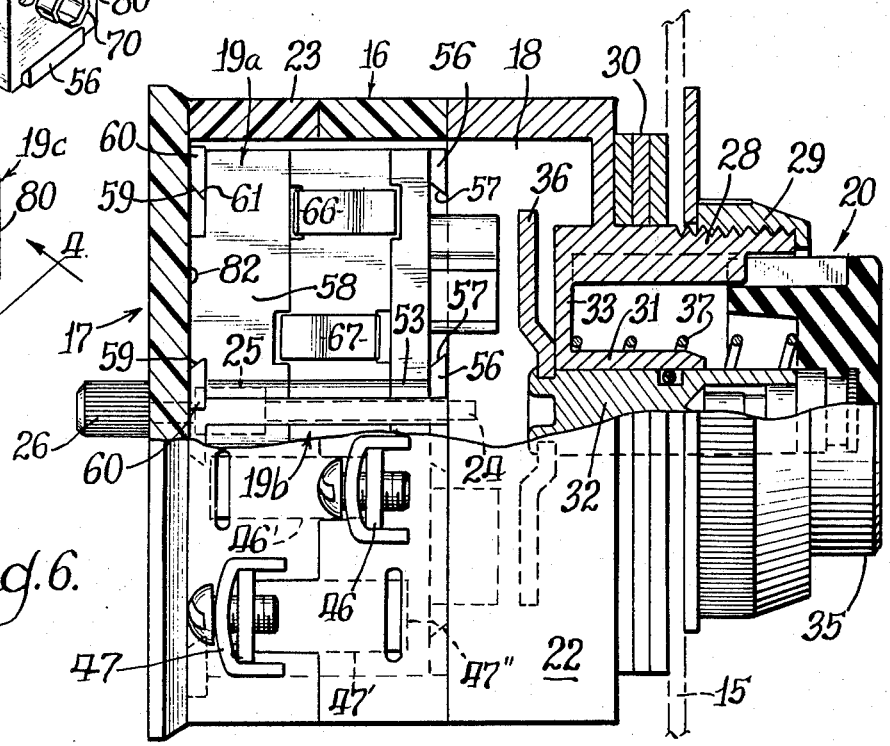
Fig. 6.

MODULAR ELECTRICAL SWITCH WITH SPLIT HOUSING

BACKGROUND AND SUMMARY OF THE INVENTION

Electrical switches that are frequently used inevitably must be changed. If, for example, the switches are on a control panel for operating a giant machine, it is important that the "down time" of the machine be minimized when a faulty switch must be changed, the reason being that large, expensive machines may have operating values in the thousands of dollars per hour. With ordinary and well-known switches, the wiring time incident to changing the switch can result in a large monetary loss. However, if the switch can be changed in a matter of minutes, the loss is minimized. The principal object of the present invention is to provide a switch construction which minimizes the down time by reason of the fact that removal and replacement of the switch does not require the manual operation of disconnecting each wire leading to the switch and then reconnecting the wires to a replacement switch.

For example, assume that on such a machine it is either time for a periodic change of switches or that there is a switch failure. Locating and rewiring a faulty switch, particularly when exposed terminals may be corroded, rusted, etc., can be a slow and tedious process. Necessarily, during the course of this process the machine must be stopped. Using the present invention, the machine must be stopped only sufficiently long to permit a subassembly of switches to be unplugged and a replacement subassembly to be plugged in, without even stopping to determine which of the individual switches of the assembly may be causing difficulty. The switches of the subassembly are contained in a housing which ameliorates the problem of corrosion, rust, etc., on the electrical components.

In some machines the stopping of the machine will have a deleterious effect upon the process being carried out by the machine. For example, on an injection molding machine, the operating temperature of the machine during a production run is critical. Shutting the system down may adversely affect the tolerances of the parts produced thereby. Should an electrical switch on such a machine fail, it is important that the switch be immediately replaced so that the critical conditions are not adversely affected. This problem is solved by the use of the present invention since a spare subassembly of switches may be kept on hand and promptly exchanged for the subassembly which includes the defective switch, when a failure occurs.

A further feature of the present invention is that the switch units can be multiplied to meet the requirements of a particular machine. On one machine, for example, it may be required that a particular push-button actuates two switches while on another machine there may be a requirement for a pushbutton to actuate six switches. Through the use of the present invention, the same components may be "stacked" so as to increase the number of individual switches actuated by a single push-button.

Furthermore, the modular switches of the present invention reduce the inventory of spare switches that must be maintained.

Additional objects and advantages will become apparent from the following description.

DESCRIPTION OF THE DRAWINGS

FIG. 1 is an elevational view, partially broken away, of an embodiment of the invention;

FIG. 2 is a view as seen at line 2—2 of FIG. 1, with a portion broken away;

FIG. 3 is an exploded view illustrating the removable cover and the manner of mounting individual switch units thereon, and also illustrating how the switch units may be stacked;

FIG. 4 is an end view of a switch unit as seen at line 4—4 of FIG. 3;

FIG. 5 is a view of the opposite end of the switch unit of FIG. 4;

FIG. 6 is an enlarged view, partially broken away, corresponding to the unit as viewed in FIG. 1;

DESCRIPTION OF SPECIFIC EMBODIMENTS

Figure 8:
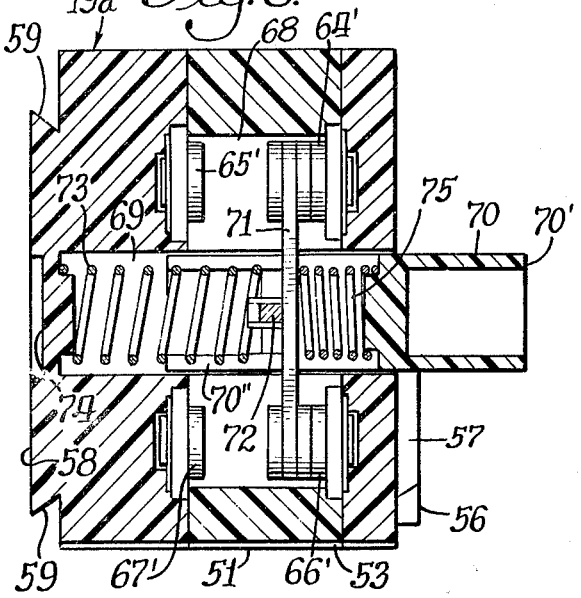
FIG. 8 is a section as seen at line 8—8 of FIG. 7.
Figure 7:
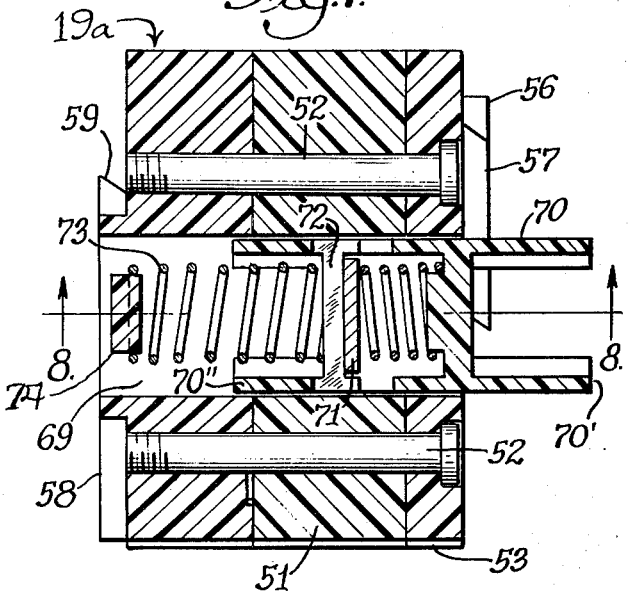
FIG. 7 is a section through a switch unit as seen at line 7—7 of FIG. 5.

The following disclosure is offered for public dissemination in return for the grant of a patent. Although it is detailed to ensure adequacy and aid understanding, this is not intended to prejudice that purpose of a patent which is to cover each new inventive concept therein no matter how others may later disguise it by variations in form or additions or further improvements.

FIGS. 1 and 6 illustrate a switch assembly suitable for mounting on a panel 15. It includes a main body or housing which comprises a fixed component, generally 16, and a cover or removable component, generally 17. These components have inner walls which define a space or enclosure 18. Within this space or enclosure 18 are a pair of unitary switch devices, generally 19*a* and 19*b*. These switch devices are operated by means of a control actuator, generally 20.

The fixed component of the housing comprises a metal part 22 and an insulator part 23. These two parts are held together by screws 24 which are threaded into the metal part. The screws have an enlarged head 25 countersunk into the insulator part 23. The heads of these screws are also tapped to receive screws 26 which hold the cover 17 in place.

The metal part 22 includes an annular boss 28. The distal end of the boss is threaded to receive a nut 29. Since the panel illustrated in FIGS. 1 and 6 is relatively thin, a plurality of washers 30 are employed to enable the nut 29 to clamp tightly against the panel and thus support the switch assembly. Within boss 28 is a sleeve 31 which serves as a journal for push rod 32 of the control actuator 20. A web 33 connects sleeve 31 and boss 28. The push rod 32 has a button 35 on the exterior end thereof and an actuator member 36 on its interior end. A compression spring 37 bears against the button 35 and the web 33 so as to urge the push rod to the position illustrated in FIG. 6.

On the exterior of the insulator part 23 are eight wire connectors or binding posts 40–47. These are for the purpose of connecting wires, such as 48, to the switch assembly. Each wire connector has a spring arm which extends through the insulating wall to the inner side thereof. At the inner side it extends along the wall to define an electrical contact. The distal end of the spring arm then extends back into the wall to lock it in place. For example, referring to FIGS. 1 and 2, the spring arm which is a part of connector 44 forms an inner contact 44′ which is approximately flush with the inner wall of the insulator part 23. The distal end 44″ of the arm is offset back into the wall and is locked in a slot midway between the inner and outer wall faces. Similarly, it will be seen in FIG. 6 that the connector 47 has an arm which forms an inner contact 47′ and a distal end 47″ locked in the wall. The remaining connectors all are similarly constructed. The insulator part 23 is made in two pieces so as to permit the assembly of the spring arms therein in the manner described.

The individual switch units 19*a*, 19*b*, etc., are all identical. So far as the details of their construction is concerned, only unit 19*a* will be described. It comprises a three-piece body 51 of insulating material. The three pieces are held together by screws 52. The body is substantially square in cross-section, but does have two corners beveled, as seen at 53. Since these beveled corners fit closely to the beveled sides 54 of projections on the inner wall of insulator part 23 (as seen in FIG. 2) they aid in ensuring that the switch units 19*a*, etc., are properly installed in the housing.

At one end of body 51 are a pair of projections 56 having slanted faces 57 facing each other in dovetail fashion so as to define the sides of a way. On the opposite end is a single projection or ridge 58 which has slanting or dovetail faces 59 which are complementary to faces 57. Similarly, the inner wall of cover 17 has two pair of projections 60 with slanting or dovetail faces 61. Each pair defines a way corresponding to the ways defined by projections 56.

On opposite sides of the body 51 are four contacts 64–67. External contact 64 is electrically connected to switch contact 64′; external contact 65 is electrically connected to switch contact 65′; external contact 66 is electrically connected to switch contact 66′; and external contact 67 is electrically connected to switch contact 67′. The switch contacts are located in a cavity 68 in the body 51. An axial opening 69 extends through the body intersecting the cavity 68. Opening 69 receives an actuating means or plunger 70 which is movable longitudinally in the opening. Plunger 70 has a bifurcated end 70′ which normally extends out of the body. It also has a bifurcated end 70″ which is within the body 51. End 70″ straddles an electrically conductive switch arm 71. The switch arm is held in place by a crossbar 72. A spring 73 bears against the crossbar and against a web 74 forming a part of the body 51. The spring resiliently urges the plunger 70 to the position illustrated. A spring 75 bears against the switch arm 71 and a transverse portion of plunger 70. This permits the switch arm 71 to float with respect to the plunger so that exact positioning of the plunger with respect to the switch contacts 64′–67′ is not critical.

In the normal position, as illustrated in FIG. 8, for example, the switch arm 71 bridges contacts 64′ and 66′, thus forming a normally closed switch between these contacts. When the plunger 70 is depressed, the switch arm is moved to the left in FIG. 8 to open that normally closed switch and bring the contacts on the switch arm into engagement with fixed contacts 65′ and 67′. In this latter position, the normally open switch formed by the switch arm and the two contacts 65′ and 67′ is closed.

To aid in obtaining proper alignment of the switch units, the front end of switch body 51 has a projecting button 80 adjacent one side of the body. Adjacent the same side, on the opposite or rear end, of the body is a socket 81 (see FIG. 5). The inner wall of cover 17 has a button 82 adjacent one side edge thereof and in the other way, defined by faces 61, there is a corresponding button (not shown) adjacent the opposite side edge of the cover.

With the assembly in the assembled condition, as illustrated in FIGS. 1 and 6, the external contacts 64–67 of the two switch units are in engagement with the internal contacts of the wire connectors 40–47 so as to form an electrical connection therebetween. Thus, for example, connector contact 44′ is in engagement with switch unit contact 66 of switch unit 19*a*, and connector contacts 46′ and 47′ are in engagement with contacts 66 and 67, respectively, of switch unit 19*b*. In this way an electrical connection is completed between the wire connectors 40–47 (and the wires, e.g. 48, connected thereto) and the two normally open and the two normally closed switches provided by the two switch units 19*a* and 19*b*.

Should it be necessary or desirable to replace a switch, this is very simply done. It is merely necessary to unscrew the two screws 26 and pull the cover 17 away from the fixed component 16 of the body. Then a replacement assembly, consisting of a cover 16 and two switch units 19*a* and 19*b*, may be reinserted and the screws 26 again tightened; or, one or both of the switch units 19*a* and 19*b* may be removed from the cover and exchanged for a new switch unit before the cover is replaced.

To remove a switch unit from the cover, it is merely slid to one side with the projection 58 sliding out of the way defined by faces 61 on the cover. Thus the switch unit 19*a* would be slid to the right as viewed in FIG. 3 and switch unit 19*b* would be slid to the left. A reverse movement is employed to replace a switch unit on the cover.

Several independent polarizing means are present to prevent the switch devices 19*a*, 19*b* from being improperly inserted into the enclosure 18, to wit: The presence of the button 82 on the cover and the socket 81 on the bottom of the switch unit ensures that the switch unit is replaced on the cover with the proper orientation. Furthermore, were the switch unit to be jammed on the cover in the wrong orientation (or perhaps by reason of the button 82 having been broken off), the switch units still cannot be improperly installed in the housing enclosure 18 because the beveled edges 53 of the switch units must mate with the beveled edges 54 in the walls defining the enclosure 18.

When the assembly is assembled and button 35 pressed (i.e. moved to the left in FIGS. 1 and 6) the member 36 moves against the outer ends 70′ of the two plungers and moves the plungers so as to open the normally closed switch and close the normally open switch, in the manner previously described.

Another feature of the invention is the ability to stack the switch units and the insulator parts 23 so as to increase the number of switches that will be actuated by the same control actuator 20. To add an additional insulator part 23, the cover 17 is removed, withdrawing the switch units from the enclosure. An additional insulator part 23*a* (FIG. 9) is then positioned in alignment with and against insulator part 23. Two additional screws 24 are inserted into the insulator part 23*a* and threaded into the tapped openings in heads 25 of the screws 24 in insulator part 23. Thus, the two insulator parts are secured together in the position illustrated in FIG. 9.

Figure 9:
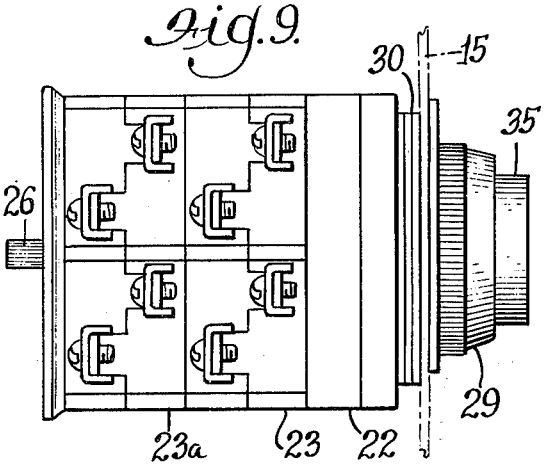
FIG. 9 is a view corresponding to FIG. 1; but illustrating the stacking of components so as to incorporate four switch units actuated by a single push-button rather than two as in FIG. 1.

A third switch unit 19*c* (FIG. 3) is then mounted on switch unit 19*b*. That is, the projection 58 on switch unit 19*c* is slid into the way defined by the faces of projections 56 of switch unit 19*b*. To permit this to be done, the plunger 70 of switch unit 19*b* is manually depressed so that the end thereof is flush with the adjacent end face of the switch unit 19*b*. When the switch unit 19*c* has been slid fully into place, the spring 73 in switch unit 19*b* will push the respective plunger outwardly so that it enters the adjacent end of opening 69 in switch unit 19*c*. The bifurcated end 70′ of switch unit 19*b* will straddle web 74 of switch unit 19*c* and move into a position adjacent the bifurcated end 70″ of switch unit 19*c*. Thus when plunger 70 of switch unit 19*c* is depressed (by member 36), the end 70″ thereof will correspondingly depress plunger 70 of switch unit 19*b*. Similarly, a fourth switch unit (not shown) is mounted onto the end of switch unit 19*a*. This subassembly of switch units is then inserted into the space within the two insulator parts 23, 23*a* and the screws 26 tightened to fix the cover in place. The completed assembly is illustrated in FIG. 9.

Figure 11:
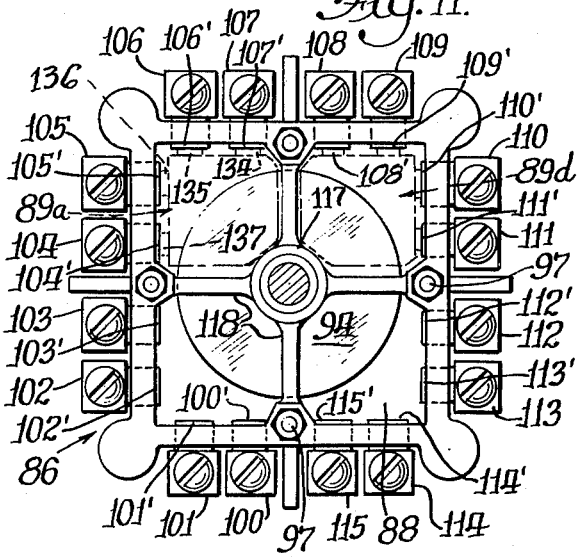
FIG. 11 is a view of the housing as seen at line 11—11 of FIG. 10 with the rear cover removed and the switch units withdrawn.
Figure 12:
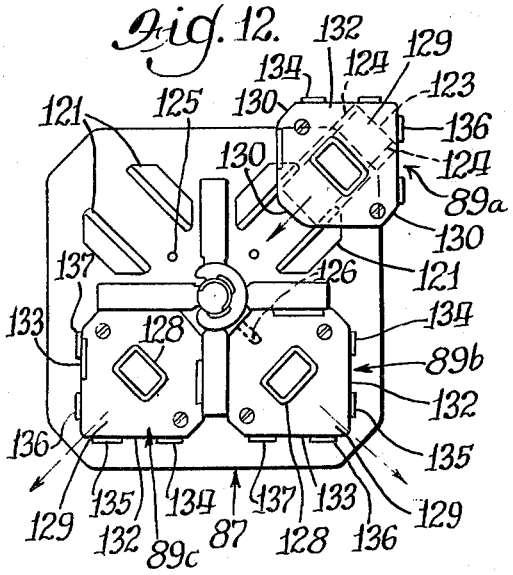
FIG. 12 is a view of the inside of the rear cover of the embodiment of FIG. 10 showing some of the switch units mounted thereon.
Figure 10:
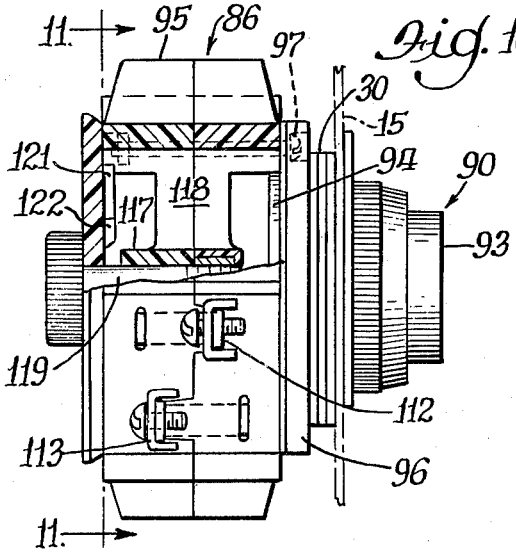
FIG. 10 is an elevational view, partially broken away, of an alternate embodiment.

FIGS. 10–12 illustrate an alternative embodiment wherein the main body comprises a fixed component, generally 86, and a cover or removable component, generally 87. These define a space or enclosure 88. This space is basically a square and holds four switch devices, generally 89*a*, 89*b*, 89*c*, etc. There is a control actuator, generally 90. The control actuator comprises a push rod which includes a push-button 93 at its outer or exposed end and an actuator member 94 at its inner end. The fixed component of the body is basically two parts, an insulator part 95 and a metal part 96. These are held together by bolts 97. As in the previously described embodiment, the insulator part 95 is actually in two pieces to facilitate the insertion of the wire connectors. These two pieces are also held together by bolts 97.

There are 16 wire connectors 100–115, four such wire connectors being associated with each switch device. Thus, in the illustrated embodiment, wire connectors 104–107 are associated with switch device 89*a*. Each wire connector has an inner contact 100′–115′, respectively, and a distal end that juts back into the body to lock it in place.

The insulator member 95 has a central hub 117 supported by four webs 118. The hub is threaded to receive a bolt 119 which holds the cover 87 in place.

The cover has four pairs of projections 121 that have inner slanting or dovetail faces 122, the faces of each pair forming a way for mounting the respective switch device. The adjacent end of each switch device has a ridge 123 which defines slanting or dovetail faces 124 which fit into the way to secure the device on the cover. At the inner end of the way defined by projections 121 is a button 125. The adjacent end of the switch device has a socket 126 to receive the respective button 125.

Extending from one end of each switch device is an actuating means or plunger 128. As in the previously described embodiment, it operates a normally open switch and a normally closed switch (not shown) within the body 129 of the switch device. When the switch devices are within the cavity 88, the plungers are adjacent actuator member 94 to be operated thereby when button 93 is depressed. The body of the switch device has three beveled corners 130. The central one of these fits about hub 117 and the outer two fit about enlargements at the ends of webs 118, through which enlargements the bolts 97 extend. This arrangement serves as a polarizing means whereby the switch device 89*a*, etc., can only be inserted within the housing in one orientation.

When properly mounted on the cover 87, the body of each switch device will have exposed walls 132 and 133, which walls lie in planes common to the adjacent switch devices. Thus, wall 132 of switch device 89*c* and wall 133 of switch device 89*b* are in a common plane. On each exposed wall are a pair of electrical contacts and the contacts connect with the normally open switch and the normally closed switch within the body. There are one pair of such contacts identified by numbers 134 and 135 and a second pair identified by numbers 136 and 137. When the switch devices are inserted into the enclosure 88, they engage the contact of the respective wire connector. Thus, contacts 134–137 of switch device 89*a* (FIG. 11) engage contacts 107′–104′, respectively.

The insulator units 95 can be stacked by using longer bolts 97 and thus define an enlarged enclosure 88. The switch units can be stacked by using an intermediate support, not shown, which fits into the thus enlarged enclosure 88.

Like the previous embodiment, should it be necessary to change one of the switch devices 89*a*, etc., it is merely necessary to unscrew bolt 119 and pull the cover 87 away from the fixed component 86. All of the switch units are withdrawn with the cover. One or more of them may be changed on the cover or a second subassembly comprising a cover and switch unit may be substituted for the first.

I claim:

1. A multiple switch assembly for attachment to electrical wires and including:

a main body comprising a fixed component and a removable component, said fixed component including a front wall and side walls integral with the front wall which walls, with said removable component, define an enclosed space, said removable component having an inner rear wall at the rear of said enclosed space;

a plurality of wiring connectors mounted on the exterior of said side walls and each being adapted to be connected to a respective one of said wires, a corresponding plurality of first electrical contacts mounted on the interior of said side walls and immediately adjacent thereto so that said space is substantially unobstructed thereby, means electrically connecting each contact with a respective connector;

a plurality of switch devices positioned in a predetermined orientation in said space, each device comprising a body, at least two second electrical contacts on the exterior of the device body, switch means in the device body to make and break an electrical connection between the second electrical contacts, and switch actuating means for operating said switch means, said device body having side walls adjacent side walls of the main body, and front and rear ends oriented toward the front and rear walls respectively of the main body, said second electrical contacts being on at least one of the device body walls and in engagement with respective first electrical contacts, said actuating means being at the device front end, means releasably securing said device rear end to said body rear wall; and a control actuator extending through said main body front wall and movable with respect thereto, said actuator having a first portion on the exterior of the body front wall for use in moving the actuator and a second portion in said space, means between said second portion and said switch actuating means for moving the latter in response to movement of the second portion;

whereby a defective device may be removed for replacement or servicing, without the necessity of detaching the wires from the connectors, by detaching said removable component from said fixed component and withdrawing said devices from the space as the removable component is moved away from the fixed component.

2. An assembly as set forth in claim 1, wherein said actuator has a longitudinal axis normal to said main body front wall and said movement of said actuator is parallel to said axis, said actuating means comprises a plunger movable in the device body parallel to said axis.

3. An assembly as set forth in claim 1, wherein there are at least two of said devices in said space in side by side arrangement, each device being in juxtaposition to said body inner rear wall and releasably secured thereto.

4. In an assembly as set forth in claim 2, wherein said fixed component comprises two parts, one of said parts forming said one side and the second of said parts defining said side walls, and including a duplicate of said second part with the two second parts being in juxtaposition, and means connecting said parts together;

said devices being positioned in pairs with the plungers of each pair having a common axis, and including means releasably connecting the bodies of the two devices of each pair so that both devices of each pair are removable as a unit with said removable component.

5. In an assembly as set forth in claim 4, wherein said means connecting said bodies of the two devices comprises:

at one of said ends said device body forming a first dovetail conformation defining a way and at the other of said ends said body forming a second complementary dovetail conformation defining a ridge receivable in said way; and said inner wall of said removable component having a dovetail conformation corresponding to one of the conformations on the devices whereby (*a*) a device may be mounted on said one part by the use of the other of the dovetail conformations on the device body and (*b*) a device may be mounted on a second device by interengagement of the dovetail conformations of the two devices.

6. In an assembly as set forth in claim 5, wherein the plunger of one device extends from a first end and into the second end of the device coaxially aligned therewith, said plungers of said coaxially aligned devices being in juxtaposition.

7. In a multiple switch assembly for attachment to electrical wires and comprising a main body defining a space and having means for the mounting thereof, a plurality of switch devices in said space, and a control actuator for operating said switch devices, the improvement comprising:

said main body comprising a fixed component and a removable component releasably secured to said fixed component, said mounting means being at one side of said main body and forming a part of the fixed component, said removable component being a cover having an inner wall and being at the opposite side of said main body, said fixed component having a plurality of inner walls adjoining said cover wall, said walls defining said space, said fixed component comprising two parts, one of said parts forming said one side and the second of said parts defining said plurality of inner walls, and including a duplicate of said second part with the two second parts being in juxtaposition, and means connecting said parts together;

a plurality of wiring connectors mounted on the fixed component, each connector being adapted to be connected to a respective one of said wires and each including a respective first electrical contact, said first contacts being positioned in a predetermined pattern within the space and parallel to at least one of said fixed component walls, there being a group of at least two of said connectors for each of said devices;

means mounting said devices in a predetermined orientation on said removable component with each device occupying a predetermined position in said space;

each of said devices comprising a body, at least two second electrical contacts on the exterior of said device body, said second electrical contact engaging the respective first contacts of the respective first group to form an electrical circuit between the respective first and second contacts, switch means to make and break an electrical connection between the first contacts, and plunger means for operating said switch means;

said control actuator having means for engaging the switch actuating means of said devices;

said devices being positioned in pairs with the plunger means of each pair having a common axis, and including means releasably connecting the bodies of the two devices of each pair so that both devices of each pair are removable as a unit with said removable component;

whereby a defective device may be removed for replacement or servicing, without the necessity of detaching the wires from the connectors, by detaching said removable component from said fixed component and withdrawing said devices from the space as the removable component is moved away from the fixed component.

8. In an assembly as set forth in claim 7, wherein said body of each device has two ends transverse to said axis;

said means connecting said bodies of the two devices comprises:

at one of said ends said device body forming a first dovetail conformation defining a way and at the other of said ends said body forming a second complementary dovetail conformation defining a ridge receivable in said way; and said inner wall of said one part having a dovetail conformation corresponding to one of the conformations on the devices whereby (*a*) a device may be mounted on said one part by the use of the other of the dovetail conformations on the device body and (*b*) a device may be mounted on a second device by interengagement of the dovetail conformations of the two devices.

9. In an assembly as set forth in claim 8, wherein the plunger of one device extends from a first end and into the second end of the device coaxially aligned therewith, said plungers of said coaxially aligned devices being in juxtaposition.

10. In an assembly as set forth in claim 8, wherein said switch means comprises a normally open switch and a normally closed switch;

each device has two of said second electrical contacts connected to said normally open switch and two of said second electrical contacts connected to said normally closed switch;

there are four of said wiring connectors each associated with a respective second electrical contact.

* * * * *

UNITED STATES PATENT AND TRADEMARK OFFICE

CERTIFICATE OF CORRECTION

PATENT NO. : 3,975,604

DATED : August 17, 1976

INVENTOR(S) : Arthur I. Appleton

It is certified that error appears in the above-identified patent and that said Letters Patent are hereby corrected as shown below:

Column 8, Line 42, "contact" should read --contacts--.

Signed and Sealed this

Sixteenth Day of November 1976

[SEAL]

*Attest:*

RUTH C. MASON
*Attesting Officer*

C. MARSHALL DANN
*Commissioner of Patents and Trademarks*